US011865396B2

(12) United States Patent
Sullivan et al.

(10) Patent No.: US 11,865,396 B2
(45) Date of Patent: Jan. 9, 2024

(54) GOLF BALL AND METHOD OF MAKING SAME

(71) Applicant: Acushnet Company, Fairhaven, MA (US)

(72) Inventors: Michael J. Sullivan, Old Lyme, CT (US); Matthew F. Hogge, Plymouth, MA (US); Derek A. Ladd, Acushnet, MA (US); Brian Comeau, Berkley, MA (US); Robert Blink, Newport, RI (US)

(73) Assignee: Acushnet Company, Fairhaven, MA (US)

( * ) Notice: Subject to any disclaimer, the term of this patent is extended or adjusted under 35 U.S.C. 154(b) by 77 days.

(21) Appl. No.: 17/540,492

(22) Filed: Dec. 2, 2021

(65) Prior Publication Data

US 2023/0173345 A1 Jun. 8, 2023

(51) Int. Cl.

| | |
|---|---|
| ***A63B 37/06*** | (2006.01) |
| ***A63B 37/00*** | (2006.01) |
| *A63B 102/32* | (2015.01) |

(52) U.S. Cl.
CPC .... *A63B 37/00221* (2020.08); *A63B 37/0024* (2013.01); *A63B 37/00223* (2020.08); *A63B 2102/32* (2015.10); *A63B 2225/76* (2020.08)

(58) Field of Classification Search
CPC ..... A63B 37/0023; A63B 37/0022
See application file for complete search history.

(56) References Cited

U.S. PATENT DOCUMENTS

| | | | | |
|---|---|---|---|---|
| 4,798,386 | A | 1/1989 | Berard | |
| 5,989,135 | A | 11/1999 | Welch | |
| 8,119,735 | B2 | 2/2012 | Hebert et al. | |
| 9,205,304 | B1 | 12/2015 | Hogge et al. | |
| 9,220,951 | B1 | 12/2015 | Comeau | |
| 10,035,043 | B2 | 7/2018 | Hogge et al. | |
| 10,077,233 | B2 | 9/2018 | Flood et al. | |
| 10,954,315 | B2 * | 3/2021 | Ke | A61K 47/6951 |
| 2011/0070975 | A1 | 3/2011 | Nagasawa et al. | |
| 2011/0224020 | A1 | 9/2011 | Tachibana et al. | |
| 2012/0021851 | A1 | 1/2012 | Hogge | |
| 2018/0178076 | A1 | 6/2018 | Hayashi | |
| 2018/0318652 | A9 | 11/2018 | Hayashi | |
| 2019/0184237 | A1 | 6/2019 | Nanba | |
| 2019/0388734 | A1 | 12/2019 | Namba et al. | |
| 2020/0038711 | A1 | 2/2020 | Hayashi et al. | |
| 2020/0406105 | A1 | 12/2020 | Suzuki et al. | |
| 2021/0162268 | A1 | 6/2021 | Hayashi et al. | |

* cited by examiner

*Primary Examiner* — Raeann Gorden

(57) ABSTRACT

Golf ball comprising one or more layers and/or indicia formed from a fluorescent composition comprising: a base polymer; and a colorant; wherein the colorant is a small-molecule ionic isolation lattice formed from one or more fluorescent dye and one or more cyanostar macrocycles. The one or more fluorescent dyes may include at least one dye selected from xanthenes, oxazines, styryls, cyanines, trianguleniums, or mixtures thereof. The colorant may be a dispersion of the small-molecule ionic isolation lattice in a carrier medium or a powder. In particular embodiments, at least one of the one or more layers is a cover layer and/or a coating layer.

19 Claims, No Drawings

GOLF BALL AND METHOD OF MAKING SAME

FIELD OF THE INVENTION

The field of the invention broadly comprises golf ball constructions creating unique overall golf ball color appearances without sacrificing golf ball durability and performance characteristics, and methods of making such golf balls.

BACKGROUND OF THE INVENTION

Today, both professional and amateur golfers alike use multi-piece, solid golf balls. A single or multi-layered core is encapsulated by at least one layer such as a single or multi-layered cover, and optionally one or more intermediate layers may be disposed there between to complete the golf ball construction.

Golf ball manufacturers pre-select the materials for each layer to target and impart desirable golf ball performance properties. Currently, a broad range of options are available for strategically incorporating and coordinating layers within each golf ball construction. In multi-layered golf balls, each of the core, intermediate layer and cover properties, such as hardness, compression, resilience, specific gravity, outer diameter, and thickness, can be preselected and coordinated to target play characteristics such as spin, initial velocity and feel of the resulting golf ball.

Furthermore, while conventional golf balls are white, some golfers enjoy distinguishing themselves on the course by playing a golf ball having a unique bright visual appearance such as golf balls incorporating fluorescent colorants. Accordingly, golf ball manufacturers seek to develop new such golf ball constructions having excellent color stability with retained brightness without sacrificing processability, durability and desirable performance characteristics.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY OF THE INVENTION

Accordingly, a golf ball of the invention comprises a layer formed from a fluorescent composition comprising: a base polymer; and a colorant; wherein the colorant is a small-molecule ionic isolation lattice formed from one or more fluorescent dyes and one or more cyanostar macrocycles.

In a particular embodiment, the one or more fluorescent dyes include at least one dye selected from xanthenes, oxazines, styryls, cyanines, trianguleniums, or mixtures thereof.

In one embodiment, the colorant is a dispersion of the small-molecule ionic isolation lattice in a carrier medium. In another embodiment, the colorant is a powder.

In one specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light do not overlap.

In another specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light at least partially overlap.

In yet another specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light encompasses the second range of wavelengths of visible light.

In a particular embodiment, the fluorescent composition of the layer is transparent or translucent.

In a specific embodiment, the base polymer of the fluorescent composition of the layer is selected from ionomers, polyurethanes, polyureas, and mixtures thereof.

In one embodiment, the golf ball comprises a core and a cover layer; wherein the cover layer is the layer formed from the fluorescent composition.

In a particular embodiment, the base polymer of the fluorescent composition of the cover layer is an ionomer, a polyurethane, a polyurea, or a mixture thereof.

In another embodiment, the golf ball comprises a core and a thermoplastic polyurethane outer cover layer; wherein the thermoplastic polyurethane outer cover layer is the layer formed from the fluorescent composition.

In yet another embodiment, the golf ball comprises a core, a cover, and a coating layer; wherein the coating layer is the layer formed from the fluorescent composition.

In a specific embodiment, the fluorescent composition of the coating layer is a latex, a lacquer or an enamel coating.

In another embodiment, the fluorescent composition of the coating layer is an acrylic, an epoxy, a urethane, a polyester, a urethane acrylate, a polyester acrylate or an alkyd coating. In a specific embodiment, the fluorescent composition of the coating layer is radiation cured.

In one embodiment, the golf ball comprises at least two coating layers including a first coating layer and a second coating layer; wherein the first coating layer is a first layer formed from a first fluorescent composition; wherein the second coating layer is a second layer formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light do not overlap.

In another embodiment, the golf ball comprises at least two coating layers including a first coating layer and a second coating layer; wherein the first coating layer is a first layer formed from a first fluorescent composition; wherein the second coating layer is a second layer formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light at least partially overlap.

In yet another embodiment, the golf ball comprises at least two coating layers including a first coating layer and a second coating layer; wherein the first coating layer is formed from a first fluorescent composition; wherein the second coating layer is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light encompasses the second range of wavelengths of visible light.

In a different embodiment, a golf ball of the invention comprises a core, a cover, a coating, and an indicia formed on an outer surface of the cover or the coating; wherein the indicia is formed from a fluorescent composition comprising: a base polymer; and a colorant; wherein the colorant is a small-molecule ionic isolation lattice formed from one or more fluorescent dyes and one or more cyanostar macrocycles.

In one embodiment, the one or more fluorescent dyes include at least one dye selected from xanthenes, oxazines, styryls, cyanines, trianguleniums, or mixtures thereof.

Non-limiting examples of indicia include logos, trademarks, patterns, markers, designs and/or decorations.

Non-limiting examples of suitable base polymers of the fluorescent composition of the indicia include urethanes, polyesters, acrylics, acetates, acrylates, epoxies, enamels, polyethers, nitrocellulose-containing polymers, solvent-based polymers, water-based polymers, plasticizer-containing polymers, UV curable polymers, vinyls, ketones, or combinations thereof.

In particular embodiments, the fluorescent composition is heat-cured, ambient-temperature-cured, moisture-cured, or radiation-cured.

In one specific embodiment wherein indica is formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light do not overlap.

In another specific embodiment wherein indicia is formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light at least partially overlap.

In yet another specific embodiment wherein indicia is formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light encompasses the second range of wavelengths of visible light.

Embodiments are also envisioned wherein the golf ball comprises two or more indicia, wherein each of at least two indicia is formed from a different fluorescent composition. In one such embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light do not overlap.

In another embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light at least partially overlap.

In yet another embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light encompasses the second range of wavelengths of visible light.

DETAILED DESCRIPTION

Advantageously, golf balls of the invention have a unique fluorescent color appearance with excellent color stability and retained/sustained greater brightness without sacrificing processability, durability and desirable performance characteristics.

A golf ball of the invention comprises a layer formed from a fluorescent composition comprising: a base polymer; and a colorant; wherein the colorant is a small-molecule ionic isolation lattice formed from one or more fluorescent dyes and one or more cyanostar macrocycles.

In a particular embodiment, the one or more fluorescent dyes include at least one dye selected from xanthenes, oxazines, styryls, cyanines, trianguleniums, or mixtures thereof.

In one embodiment, the colorant is a dispersion of the small-molecule ionic isolation lattice in a carrier medium. In another embodiment, the colorant is a powder.

Fluorescent dyes, or fluorophores, are compounds that absorb light at a given wavelength and emit light at a longer wavelength, producing fluorescence in various colors. Fluorescent dyes are highly emissive in liquid concentrate or in solution but display quenching when incorporated in a solid. Fluorescence quenching refers to any process that decreases the intensity of the fluorescence of a fluorophore caused by a variety of molecular interactions with a quencher molecule.

A golf ball of the invention incorporates one or more layer formed from a fluorescent composition which is visibly uniformly brighter when observed under ultraviolet (UV) light and/or white light than an otherwise identical fluorescent composition without any ionic sequestering cyanostar macrocycle therein. In turn, the resulting golf ball comprising a layer formed from a fluorescent composition is brighter when observed under ultraviolet (UV) light and/or white light than an otherwise identical golf ball that does not include any ionic sequestering cyanostar macrocycle therein.

In this regard, the small-molecule ionic isolation lattice formed from one or more fluorescent dyes and one or more cyanostar macrocycles rescues the emission intensity (brightness), and the spectral properties of a fluorescent dye seen in a dilute solution are reinstated and superior fluorescence properties are thereby produced compared to an otherwise identical fluorescent composition without any ionic sequestering cyanostar macrocycle in which case the cationic fluorescent dye of the resulting layer would be highly quenched and therefore dull.

The chemical structure of an ionic sequestering cyanostar macrocycle appears in formula (I) below:

Formula (I)

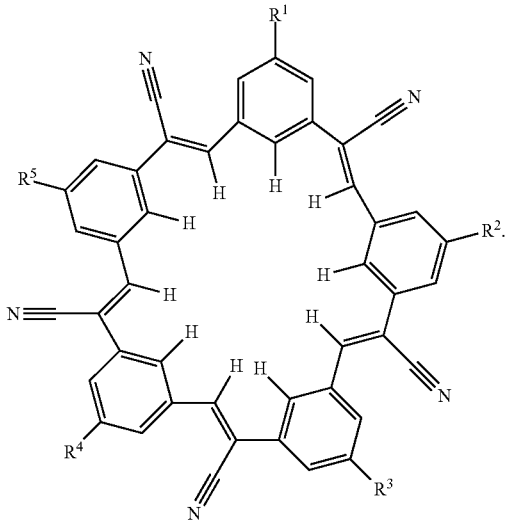

In this regard, $R_1$-$R_5$ of formula I are substituents/moieties which may be selected to target and/or adjust the properties of a given ionic sequestering cyanostar macrocycle. In one embodiment, substituents/moieties $R_1$-$R_5$ are the same. In another embodiment, substituents/moieties $R_1$-$R_5$ at least partially differ.

In a specific embodiment, $R^1$, $R^2$, $R^3$, $R^4$, and $R^5$ are each independently selected from the group consisting of alkenyl, alkyl, alkoxy, alkyl-NH-alkyl, aryl, cycloalkyl, heteroaryl, heterocycle, haloalkyl, hydrogen, iodo, —$OR^6$, —$N(R^7R_8)$, —$CO_2R^9$, —C(O)—$N(R_{10}R^{11})$), wherein $R^6$, $R^7$, $R^8$, $R^9$, $R^{10}$, and $R^{11}$ are each independently selected from the group consisting of alkenyl, alkyl, alkoxy, alkyl-NH-alkyl, aryl, arylalkyl, cycloalkyl, heteroaryl, heterocycle, haloalkyl, and hydrogen. See, e.g., U.S. Pat. No. 10,077,233 of Flood et al., hereby incorporated by reference herein in its entirety.

Additionally, the fluorescent contribution(s) to the overall color appearance of a golf ball of the invention can be measured using a bispectral spectrofluorometer according to ASTM E2153-01 (2017), wherein reflected and fluorescent spectral radiance factors are measured as a function of incident wavelength, producing illuminant-independent data and thus colorimetric calculations that apply irrespective of the light source. Bispectral spectrophotometric instruments can make colorimetric measurements considering the contribution of both the fluorescent and the reflected component to the total radiance of a sample.

In contrast, conventional spectrophotometers use polychromatic illumination and only measure the total radiance factor of fluorescent materials for the light source in the particular instrument employed—therefore the measurements cannot be used to obtain accurate colorimetry for other illuminants or sources.

The bispectral method incorporates two monochromators into the instrument—one monochromator is located between the instrument light source and the sample to be measured, the function of this monochromator being to separate the radiation from the instrument's light source into its spectral components before it reaches the sample. The second monochromator is located between the sample and the photodetector, which separates the radiation leaving the sample surface into its spectral components. This way, the instrument produces a matrix of all the wavelength contributions of light excitation wavelengths, emission wavelengths, the reflected component, and the fluorescent contribution.

The output data from bispectral measurements is a matrix with wavelength by wavelength contribution of light excitation and emission.

Otherwise, it is also envisioned that a golf ball of the invention and layers thereof may have any known overall color appearance displaying colors having any known color coordinates L*, a*, b* in the CIELAB color space as measured using a standard colorimeter. The L* value represents lightness, the a* value represents the degree of redness (positive a* to 100) and greenness (negative a* to −100), and the b* value represents the degree of yellowness (positive b* up to 100) and blueness (negative b* to −100).

In this regard, the color difference between two given colors as measured in the CIELAB color space may be quantified by $\Delta E^*_{ab}$ according to the following equation:

$$\Delta E^*_{ab}=\sqrt{(L^*_2-L^*_1)^2+(a^*_2-a^*_1)^2+(b^*_2-b^*_1)^2}.$$

Meanwhile, the h° value in the CIELAB color space represents a hue angle)(h°) of from 0° to 360° on the CIELAB diagram which may be quantified by h° according to the following equation:

$$h°=\arctan(b^*/a^*).$$

In turn, the C* value in the CIELAB color space represents chroma, the amount of saturation of a color. Chroma is the distance of the color point to the L*-axis. Colors of high chroma are said to be clearer, brighter or more brilliant than colors having a lower chroma. Chroma as used herein can be quantified by C* according to the following equation:

$$C^*=\sqrt{a^{*2}+b^{*2}}.$$

In one specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light do not overlap.

In another specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light at least partially overlap.

In yet another specific embodiment, the fluorescent composition comprises a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light encompasses the second range of wavelengths of visible light.

In a particular embodiment, the fluorescent composition of the layer is transparent or translucent. Herein, a layer referred to as "translucent" preferably has an average transmittance of visible light of at least about 10% and less than 100%. In turn, a layer referred to as "transparent" preferably transmits 100% of visible light.

In a specific embodiment, the base polymer of the fluorescent composition of the layer is selected from ionomers and polyurethanes.

Suitable ionomers include O/X, E/X, O/X/Y, and E/X/Y-type copolymers that are at least partially neutralized with one or more cation(s), optionally in the presence of an organic acid, such as disclosed in U.S. Pat. No. 6,756,436, the entire disclosure of which is hereby incorporated herein by reference. Specifically, 0 is an α-olefin, E is ethylene, X is a $C_3$-$C_8$ α,β-ethylenically unsaturated carboxylic acid, and Y is a softening monomer.

The term, "copolymer," as used herein, includes polymers having two types of monomers, those having three types of monomers, and those having more than three types of monomers.

A partially neutralized ionomer has about 70 percent or less of acid groups present neutralized by at least one cation, while a highly neutralized polymer (HNP) has greater than about 70 percent of acid groups present neutralized by the cation (s), and embodiments are even envisioned wherein an excess amount of cation is included in addition to that sufficient to neutralized 100% of the acid groups present.

Suitable cations include, but are not limited to, metal ion sources, such as compounds of alkali metals, alkaline earth metals, transition metals, and rare earth elements; ammonium salts and monoamine salts; or combinations thereof. Preferred cations include for example compounds of magnesium, sodium, potassium, cesium, calcium, barium, manganese, copper, zinc, lead, tin, aluminum, nickel, chromium, lithium, rare earth metals, or combinations thereof.

The "O" is preferably selected from ethylene and propylene. Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid monoester, ethylene/maleic acid, ethylene/maleic acid mono-ester, ethylene/(meth)acrylic acid/n-butyl (meth)acrylate, ethylene/(meth)acrylic acid/iso-butyl (meth)acrylate, ethylene/(meth)acrylic acid/methyl (meth)acrylate, ethylene/(meth) acrylic acid/ethyl (meth)acrylate terpolymers, and the like.

The acid copolymer can be reacted with the optional high molecular weight organic acid and the cation(s) simultaneously, or prior to the addition of the cation(s).

In some embodiments, X is preferably selected from methacrylic acid, acrylic acid, ethacrylic acid, crotonic acid, and itaconic acid. Methacrylic acid and acrylic acid are particularly preferred. In turn, Y is preferably an acrylate selected from alkyl acrylates and aryl acrylates and preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate.

Some preferred E/X/Y-type copolymers are those wherein X is (meth) acrylic acid and/or Y is selected from (meth) acrylate, n-butyl (meth) acrylate, isobutyl (meth) acrylate, methyl (meth) acrylate, and ethyl (meth) acrylate. Some more preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

As used herein, "(meth) acrylic acid" means methacrylic acid and/or acrylic acid. Likewise, "(meth) acrylate" means methacrylate and/or acrylate.

The amount of ethylene in the acid copolymer is typically at least 15 wt. %, preferably at least 25 wt. %, more preferably least 40 wt. %, and even more preferably at least 60 wt. %, based on total weight of the copolymer. The amount of $C_3$ to $C_8$ α, β-ethylenically unsaturated mono- or dicarboxylic acid in the acid copolymer is typically from 1 wt. % to 35 wt. %, preferably from wt. % to 30 wt. %, more preferably from 5 wt. % to 25 wt. %, and even more preferably from 10 wt. % to 20 wt. %, based on total weight of the copolymer. The amount of optional softening comonomer in the acid copolymer is typically from 0 wt. % to 50 wt. %, preferably from 5 wt. % to 40 wt. %, more preferably from 10 wt. % to 35 wt. %, and even more preferably from 20 wt. % to 30 wt. %, based on total weight of the copolymer.

"Low acid" and "high acid" ionomeric polymers, as well as blends of such ionomers, may be used. In general, low acid ionomers are considered to be those containing 16 wt. % or less of acid moieties, whereas high acid ionomers are considered to be those containing greater than 16 wt. % of acid moieties.

Ionomers may encompass those polymers obtained by copolymerization of an acidic or basic monomer, such as (meth)acrylic acid, with at least one other comonomer, such as an olefin, styrene or vinyl acetate, followed by at least partial neutralization. Alternatively, acidic or basic groups may be incorporated into a polymer to form an ionomer by reacting the polymer, such as polystyrene or a polystyrene copolymer including a block copolymer of polystyrene, with a functionality reagent, such as a carboxylic acid or sulfonic acid, followed by at least partial neutralization. Suitable neutralizing sources include cations for negatively charged acidic groups and anions for positively charged basic groups.

Non-limiting examples of commercially available ionomers suitable for use with the present invention include for example SURLYN® ionomers from DuPont and Iotek® ionomers from Exxon. In this regard, examples of SURLYN® ionomers include SURLYN®7940(Li), SURLYN® 8940 (Na) and SURLYN® 9650 (Zn), which are medium acid ionomer resins; and SURLYN® 9910 (Zn), a low acid ionomer resin. Additional examples of suitable low acid ionomers include Escor® 4000/7030 and Escor® 900/8000, disclosed in U.S. Pat. Nos. 4,911,451 and 4,884,814, the disclosures of which are incorporated by reference herein. Meanwhile, examples of high acid ionomer resins include SURLYN(® 8140 (Na), SURLYN®9150 (Zn) and SURLYN® 8546 (Li). The acid groups of the low, medium and high acid ionomer resins have been neutralized to a certain degree with the designated cation.

In a particular embodiment, ionomers may be selected from DuPont® HPF ESX 367, HPF 1000, HPF 2000, HPF AD1035, HPF AD1035 Soft, HPF AD1040, and AD1172 ionomers, commercially available from E. I. du Pont de Nemours and Company.

Suitable HNPs include, but are not limited to, polymers containing α,β-unsaturated carboxylic acid groups, or the salts thereof, that have been highly neutralized by organic fatty acids. Such HNPs are commercially available from DuPont under the trade name HPF, e.g., HPF 1000 and HPF 2000. The HNP can also be formed using an oxa-containing compound as a reactive processing aid to avoid processing problems, as disclosed in U.S. Patent Publication No. 2003/0225197. In particular, an HNP can include a thermoplastic resin component having an acid or ionic group, i.e., an acid polymer or partially neutralized polymer, combined with an oxa acid, an oxa salt, an oxa ester, or combination thereof and an inorganic metal compound or organic amine compound.

In addition, the HNP can be formed from an acid copolymer that is neutralized by one or more amine-based or ammonium-based components, or mixtures thereof, as disclosed in U.S. Pat. No. 7,160,954 entitled "Golf Ball Compositions Neutralized with Ammonium-Based and Amine-Based Compounds," which is incorporated in its entirety by reference herein.

An acid copolymer that is partially or highly neutralized in a manner described above may be subjected to additional neutralization using more traditional processes, e.g., neutralization with salts of organic fatty acids and/or a suitable cation(s).

Meanwhile, the base polymer may alternatively or additionally comprise a thermoplastic or thermoset polyurethane composition. In general, polyurethanes contain urethane linkages formed by reacting an isocyanate group (—N═C═O) with a hydroxyl group (OH). The polyurethanes are produced by the reaction of a multi-functional isocyanate (NCO—R—NCO) with a long-chain polyol having terminal hydroxyl groups (OH—OH) in the presence of a catalyst and other additives. The chain length of the polyurethane prepolymer is extended by reacting it with short-chain diols (OH—R'—OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

By the term, "isocyanate compound" as used herein, it is meant any aliphatic or aromatic isocyanate containing two or more isocyanate functional groups. The isocyanate compounds can be monomers or monomeric units because they can be polymerized to produce polymeric isocyanates containing two or more monomeric isocyanate repeat units. The isocyanate compound may have any suitable backbone chain structure including saturated or unsaturated, and linear, branched, or cyclic. By the term, "polyamine" as used herein, it is meant any aliphatic or aromatic compound containing two or more primary or secondary amine functional groups. The polyamine compound may have any suitable backbone chain structure including saturated or unsaturated, and linear, branched, or cyclic. The term "polyamine" may be used interchangeably with amine-terminated component. By the term, "polyol" as used herein, it is meant any aliphatic or aromatic compound containing two or more hydroxyl functional groups. The term "polyol" may be used interchangeably with hydroxy-terminated component.

Thermoplastic polyurethanes have minimal cross-linking; any bonding in the polymer network is primarily through hydrogen bonding or other physical mechanism. Because of their lower level of cross-linking, thermoplastic polyurethanes are relatively flexible. The cross-linking bonds in thermoplastic polyurethanes can be reversibly broken by increasing temperature such as during molding or extrusion. That is, the thermoplastic material softens when exposed to heat and returns to its original condition when cooled.

Thermoplastic polyurethanes are therefore particularly desirable as an outer cover layer material. Non-limiting examples of suitable thermoplastic polyurethanes include TPUs sold under the tradenames of Texin® 250, Texin® 255, Texin® 260, Texin® 270, Texin®950U, Texin® 970U, Texin@1049, Texin@990DP7-1191, Texin® DP7-1202, Texin®990R, Texin®993, Texin® DP7-1049, Texin® 3203, Texin® 4203, Texin® 4206, Texin® 4210, Texin® 4215, and Texin® 3215, each commercially available from Covestro LLC, Pittsburgh PA; Estane® 50 DT3, Estane®58212, Estane®55DT3, Estane®58887, Estane® EZ14-23A, Estane® ETE 50DT3, each commercially available from Lubrizol Company of Cleveland, Ohio; and Elastollan® WY1149, Elastollan@1154D53, Elastollan@1180A, Elastollan@1190A, Elastollan@1195A, Elastollan@1185AW, Elastollan@1175AW, each commercially available from BASF; Desmopan® 453, commercially available from Bayer of Pittsburgh, PA, and the E-Series TPUs, such as D 60 E 4024 commercially available from Huntsman Polyurethanes of Germany.

On the other hand, thermoset polyurethanes become irreversibly set when they are cured. The cross-linking bonds are irreversibly set and are not broken when exposed to heat. Thus, thermoset polyurethanes, which typically have a high level of cross-linking, are relatively rigid.

Aromatic polyurethanes can be prepared in accordance with this invention and these materials are preferably formed by reacting an aromatic diisocyanate with a polyol. Suitable aromatic diisocyanates that may be used in accordance with this invention include, for example, toluene 2,4-diisocyanate (TDI), toluene 2,6-diisocyanate (TDI), 4,4'-methylene diphenyl diisocyanate (MDI), 2,4'-methylene diphenyl diisocyanate (MDI), polymeric methylene diphenyl diisocyanate (PMDI), p-phenylene diisocyanate (PPDI), m-phenylene diisocyanate (PDI), naphthalene 1,5-diisocynate (NDI), naphthalene 2,4-diisocyanate (NDI), p-xylene diisocyanate (XDI), and homopolymers and copolymers and blends thereof. The aromatic isocyanates are able to react with the hydroxyl or amine compounds and form a durable and tough polymer having a high melting point. The resulting polyurethane generally has good mechanical strength and cut/shear-resistance.

Aliphatic polyurethanes also can be prepared in accordance with this invention and these materials are preferably formed by reacting an aliphatic diisocyanate with a polyol. Suitable aliphatic diisocyanates that may be used in accordance with this invention include, for example, isophorone diisocyanate (IPDI), 1,6-hexamethylene diisocyanate (HDI), 4,4'-dicyclohexylmethane diisocyanate ("$H_{12}$ MDI"), meta-tetramethylxylyene diisocyanate (TMXDI), trans-cyclohexane diisocyanate (CHDI), and homopolymers and copolymers and blends thereof. Particularly suitable multifunctional isocyanates include trimers of HDI or $H_{12}$ MDI, oligomers, or other derivatives thereof. The resulting polyurethane generally has good light and thermal stability.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG) which is particularly preferred, polyethylene propylene glycol, polyoxypropylene glycol, and mixtures thereof. The hydrocarbon chain can have saturated or unsaturated bonds and substituted or unsubstituted aromatic and cyclic groups.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

There are two basic techniques that can be used to make the polyurethanes: a) one-shot technique, and b) prepolymer technique. In the one-shot technique, the diisocyanate, polyol, and hydroxyl-terminated chain-extender (curing agent) are reacted in one step. On the other hand, the prepolymer technique involves a first reaction between the diisocyanate and polyol compounds to produce a polyurethane prepolymer, and a subsequent reaction between the prepolymer and hydroxyl-terminated chain-extender. As a result of the reaction between the isocyanate and polyol compounds, there will be some unreacted NCO groups in the polyurethane prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

In one embodiment, the isocyanate compound is added to a reaction vessel and then a curative mixture comprising the polyol and curing agent is added to the reaction vessel. The components are mixed together so that the molar ratio of isocyanate groups to hydroxyl groups is preferably in the range of about 1.00:1.00 to about 1.10:1.00.

In a second embodiment, the prepolymer method is used. In general, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single chain-extender or blend of chain-extenders as known in the golf ball art. As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. In general, thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio.

A catalyst may be employed to promote the reaction between the isocyanate and polyol compounds for producing the prepolymer or between prepolymer and chain-extender during the chain-extending step. Preferably, the catalyst is added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 2, 2'-(1,4-phenylenedioxy)diethanol, 1,3-bis-{2[2-(2-hydroxyethoxy) ethoxy] ethoxy}cyclohexane; trimethylolpropane; polytetramethylene ether glycol (PTMEG), preferably having a molecular weight from about 250 to about 3900; and mixtures thereof.

Suitable amine chain-extending (curing) agents that can be used in chain-extending the polyurethane prepolymer include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"); and mixtures thereof. One particularly suitable amine-terminated chain-extending agent is Ethacure 300™ (dimethylthiotoluenediamine or a mixture of 2,6-diamino-3,5-dimethylthiotoluene and 2,4-diamino-3,5-dimethylthiotoluene). The amine curing agents used as chain extenders normally have a cyclic structure and a low molecular weight (250 or less).

When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

In addition, the polyurethane compositions may contain fillers, additives, and other ingredients that do not detract from the properties of the final composition. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives.

Other suitable additives include antioxidants, stabilizers, softening agents, plasticizers, including internal and external plasticizers, impact modifiers, foaming agents, density-adjusting fillers, reinforcing materials, compatibilizers, and the like. Some examples of useful fillers include zinc oxide, zinc sulfate, barium carbonate, barium sulfate, calcium oxide, calcium carbonate, clay, tungsten, tungsten carbide, silica, and mixtures thereof. Rubber regrind (recycled core material) and polymeric, ceramic, metal, and glass microspheres also may be used. Generally, the additives will be present in the composition in an amount between about 1 and about 70 weight percent based on total weight of the composition depending upon the desired properties.

In one embodiment, the golf ball comprises a core and a cover layer; wherein the cover layer is the layer formed from the fluorescent composition.

In a particular embodiment, the base polymer of the fluorescent composition of the cover layer is a polyurethane or an ionomer such as described above.

In another embodiment, the golf ball comprises a core and a thermoplastic polyurethane outer cover layer; wherein the thermoplastic polyurethane outer cover layer is the layer formed from the fluorescent composition.

In yet another embodiment, the golf ball comprises a core, a cover, and a coating layer; wherein the coating layer is the layer formed from the fluorescent composition.

In a specific embodiment, the fluorescent composition of the coating layer is a latex, a lacquer or an enamel coating.

In another embodiment, the fluorescent composition of the coating layer comprises an acrylic, an epoxy, a urethane, a polyester, a urethane acrylate, a polyester acrylate or an alkyd.

In a specific embodiment, the fluorescent composition of the coating layer is radiation cured.

In one embodiment, the golf ball comprises at least two coating layers including a first coating layer and a second coating layer; wherein the first coating layer is a first layer formed from a first fluorescent composition; wherein the second coating layer is a second layer formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light do not overlap.

In another embodiment, the golf ball comprises at least two coating layers including a first coating layer and a second coating layer; wherein the first coating layer is a first layer formed from a first fluorescent composition; wherein the second coating layer is a second layer formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light at least partially overlap.

In yet another embodiment, the golf ball comprises at least two coating layers including a first coating layer and a second coating layer; wherein the first coating layer is a first layer formed from a first fluorescent composition; wherein the second coating layer is a second layer formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light encompasses the second range of wavelengths of visible light.

It is envisioned that a golf ball of the invention may include two or more layers, wherein each of at least two layers is formed from the same fluorescent composition.

In other embodiments, a golf ball of the invention may include at least two layers, wherein each of at least two layers is formed from a different fluorescent composition. For example, in one embodiment, a golf ball of the invention comprises a first layer and a second layer; wherein the first layer is formed from a first fluorescent composition and the second layer is formed from a second fluorescent composition; wherein the first fluorescent composition is different than the second fluorescent composition.

In one such embodiment, the first fluorescent composition comprises a first base polymer and the second fluorescent composition comprises a second base polymer; wherein the first base polymer is different than the second base polymer.

In one such embodiment, the first fluorescent composition further comprises a first small-molecule ionic isolation lattice and the second fluorescent composition further comprises a second small-molecule ionic isolation lattice, wherein the first small-molecule ionic isolation lattice is different than the second small-molecule ionic isolation lattice.

In this regard, the first small-molecule ionic isolation lattice may differ from the second small-molecule ionic isolation lattice with respect to preselected fluorescent dyes and/or with respect to preselected cyanostar macrocycles.

In another such embodiment, the first fluorescent composition further comprises a first small-molecule ionic isolation lattice and the second fluorescent composition further comprises a second small-molecule ionic isolation lattice, wherein the first small-molecule ionic isolation lattice and the second small-molecule ionic isolation lattice are the same.

When incorporated in a coating layer, the fluorescent composition has sufficient hardness to withstand the great force and impact of a club face striking the golf ball. In this regard, ASTM D2134 and a Sward-type hardness rocker are used to confirm that a coating layer formed from the fluorescent composition has a Sward-type hardness that is within a suitable range. Non-limiting examples of suitable Sward Rocker Hardness values include a Sward Rocker Hardness value of about 5 or greater, or a Sward Rocker Hardness value of about 10 or greater, or a Sward Rocker Hardness value of from about 30 to 80, or a Sward Rocker Hardness value of from about 40 to 70, or a Sward Rocker Hardness value of from about 45 to 60, or a Sward Rocker Hardness value of less than about 40, or a Sward Rocker Hardness value of less than about 35, or a Sward Rocker Hardness value of at least 40, and/or a Sward Rocker Hardness value of at least 45.

Additionally, ASTM D3363 is used to confirm that a coating layer formed from the fluorescent composition has sufficient pencil hardness. An inventive coating layer formed from fluorescent composition may have a pencil hardness, for example, in excess of 3H on the scale, a pencil hardness rating of from about 3H to about 7H on the scale, a pencil hardness of HB on the scale, a pencil hardness of less than about HB on the scale, a pencil hardness of B on the scale, or a pencil hardness of 2B.

Meanwhile, in some embodiments, the moisture barrier properties of a layer formed from a fluorescent composition are targeted. In such embodiments, these moisture barrier properties are confirmed by ascertaining the normalized moisture vapor transition rate (nMVTR) thereof. Normalized MVTRs compare the ability of materials to resist moisture penetration irrespective of the thickness of the material and can be determined by the equation VTR(g·mm/$m^2$·day)·(1/thickness (mm)) or g/($m^2$·day). Non-limiting examples of suitable nMVTRs include an nMVTR of less than about 5.0, an nMVTR in the range of 3.9 to 6.3, an nMVTR in the range of less than 9.0, and/or or an nMVTR of from 9.0 to 12.0.

Moreover, the flexural modulus of a fluorescent composition is tailored and confirmed using ASTM D790. In some embodiments, the fluorescent composition may have a relatively low modulus with a lower limit of 1,000 or 5,000 or 10,000 or 15,000 or 20,000 or 25,000 or psi and an upper limit of 40,000 or 45,000 or 50,000 or 60,000 or 70,000 or 80,000. The hardness of the low modulus material is generally 30 Shore D or greater; or 40 Shore D or greater; or 50 Shore D or greater, or preferably within a range having a lower limit of 30 or 40 or Shore D and an upper limit of 60 or 70 or 80 or 85 Shore D.

Alternatively, the fluorescent composition may be tailored to have a relatively high modulus within the range having a lower limit of 90,000 or 100,000 or 110,000 or 120,000 or 130,000 or 140,000 or 150,000 psi and an upper limit of 200,000 or 300,000 or 400,000 or 500,000 or greater and a hardness of 40 Shore D or greater, or 50 Shore D or greater, or 60 Shore D or greater, or within a range having a lower limit of 40 or 50 or 60 Shore D and an upper limit of 80 or 90 or 100 Shore D.

Meanwhile, the fluorescent composition may also be tailored to have a suitable tensile strength. Non-limiting examples of suitable fluorescent composition tensile strengths include at least 500 psi, at least 1,000 psi, at least 2,000 psi, at least 5,000 psi, at least 6,000 psi, at least 7,000 psi, at least 8,000 psi, or at least 10,000 psi. Tensile Strength(psi) may be measured using ASTM D638.

The fluorescent composition may also be tailored to have a suitable elongation at break. Non-limiting examples of suitable fluorescent composition elongation at breaks include 10% to 200%, about 20 to 1000%, at least 25%, or at least about 50%, or at least 100%, or 200% or greater, or 300% or greater, or at least about 400% to about 800%. Elongation at break (%) may be measured using ASTM D638.

Furthermore, the fluorescent composition may be tailored to have a suitable Izod impact strength. Non-limiting examples of suitable fluorescent composition Izod impact strengths include greater than 0.90 ft.lb./in., at least 1.0 ft.lb./in., greater than 1.0 ft.lb./in., or at least 2.0 ft.lb./in. Izod impact strength may be measured using Izod Impact Test (ft.lb./in.) ASTM D256.

The durability and properties of the resulting golf ball of the invention and inventive layer thereof formed from a fluorescent composition are evaluated using test methods such as but not limited to the following.

Dual Pendulum Durability

At least twelve golf balls are struck 200 times using a Titleist-made Rotating Pendulum Testing Machine. The machine is configured to strike/hit golf balls repeatedly with a grooved-metal face-plate, rotating at 1100 rpm, that is positioned 13.5 inches from the drive motor and angled at approximately 13 degrees. An assessment of failure is made every 50 hits using a black light to monitor when/if the coating failure began to occur.

After the golf balls are hit 200 times, each golf ball is then evaluated for crazing of the outermost coating layer (cracks or lines that appear in the coating once dried) via Graphite Rub Test by rubbing pencil graphite shavings on the surface of the golf ball and then observation is made as to evidence of cracks/spider webbing occurring on the golf ball.

Golf balls having a coating layer formed from a fluorescent composition according to the present invention preferably do not exhibit cracks/spider webbing, ridges, bumps, holes or tears.

Cold Crack

Golf balls are conditioned at −5° F. in a refrigerator, followed by hitting the golf balls on a CoR machine once a day for 5 days @ 125 ft/sec. and then inspected for coating cracking.

Golf balls having a coating layer formed from a fluorescent composition according to the present invention preferably do not exhibit coating cracking under the cold crack test.

Water Immersion Test

Golf balls are immersed in weight 1800-2000 g of water contained within paint cans, noting the date/time that the golf balls were immersed in the paint cans.

Following 5 days of immersion, the golf balls are removed from the paint cans and observed for coating blisters/peeling/other changes.

Golf balls having a coating layer formed from a fluorescent composition according to the present invention preferably do not exhibit coating blisters, peeling, or other changes under the water immersion test.

Fertilizer Immersion Test

Fertilizer is combined with water at 200 g. of fertilizer per 2000 g of water in paint cans. Golf balls are immersed in the paint cans for 5 days, noting the date/time of immersion.

The golf balls are then removed from the paint cans and inspected for coating blisters/peeling under black light to observe changes.

Golf balls having a coating layer formed from a fluorescent composition according to the present invention preferably do not exhibit blisters/peeling/under black light.

Oven Aging

Golf balls are placed in an oven and heated at 150° F. for 16 hours, followed by inspecting the golf balls under black light for defects.

Golf balls having a coating layer formed from a fluorescent composition according to the present invention preferably do not exhibit defects under the oven aging test.

Delamination

Golf balls are tested for delamination in order to demonstrate golf ball durability. As used herein, "delamination" refers to a condition wherein the cover exhibits stratification of the cover material into layers within the cover layer itself and these various layers "onion-skin" or peel off. Such delamination can typically be observed visually and can be confirmed through a simple manual test wherein a knife blade is used to "peel" the cover, exposing the stratification of the cover material. Layer separation may be visually apparent as "bubbling" or air pockets between the two layers. Delamination detrimentally affects not only the appearance of the golf ball but playability as well.

Golf balls having a cover or other non-coating layer formed from a fluorescent composition according to the present invention preferably do not exhibit delamination.

Peel Test

The peel strength from cover layer to adjacent casing layer is evaluated by performing the Peel Test. In particular, a strip of approximately ½ inch is cut around an equator of the golf ball, deep enough to cut through the entire layer to be tested. Next, a perpendicular cut is made across the strip and one end of the strip peeled back just enough to make a tab of about ½ inch. The ball is then clamped into a jig by poles with the tab facing upward. The jig allows the clamped ball to freely rotate about an axis parallel to the poles. The tab is then clamped to a 20 lb. load cell of a universal testing machine. The tab is pulled away from the ball at a rate of 0.5 in./min., and the force required to pull the outer layer off of the underlying layer is recorded.

Golf balls having a cover or other golf ball layer formed from a fluorescent composition according to the present invention preferably exhibit a peel strength of at least 15 lbs./in.

In a different embodiment, a golf ball of the invention comprises a core, a cover, a coating, and an indicia formed on an outer surface of the cover or the coating; wherein the indicia is formed from a fluorescent composition comprising: a base polymer; and a colorant; wherein the colorant is a small-molecule ionic isolation lattice formed from one or more fluorescent dyes and one or more cyanostar macrocycles.

In one embodiment, the one or more fluorescent dyes include at least one dye selected from xanthenes, oxazines, styryls, cyanines, trianguleniums, or mixtures thereof.

Non-limiting examples of indicia logos, trademarks, patterns, markers, designs and/or decorations.

Non-limiting examples of suitable base polymers of the fluorescent composition of the indicia include urethanes, polyesters, acrylics, acetates, acrylates, epoxies, enamels, polyethers, nitrocellulose-containing polymers, solvent-based polymers, water-based polymers, plasticizer-containing polymers, UV curable polymers, vinyls, ketones, or combinations thereof.

In particular embodiments, the fluorescent composition is heat-cured, ambient-temperature-cured, moisture-cured, or radiation-cured.

In one specific embodiment wherein indicia is formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light do not overlap.

In another specific indicia embodiment wherein indicia is formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light and the second range of wavelengths of visible light at least partially overlap.

In yet another specific embodiment wherein indicia id formed from the fluorescent composition, the one or more fluorescent dyes of the small-molecule ionic isolation lattice includes a first fluorescent dye and a second fluorescent dye; wherein the first fluorescent dye emits light within a first range of wavelengths of visible light as measured according to ASTM E2153-01 (2017); wherein the second fluorescent dye emits light within a second range of wavelengths of visible light as measured according to ASTM E2153-01 (2017); and wherein the first range of wavelengths of visible light encompasses the second range of wavelengths of visible light.

Embodiments are also envisioned wherein the golf ball comprises two or more indicia, wherein at least two indicia are formed from the same fluorescent composition or differing fluorescent compositions. In one such embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light do not overlap.

In another embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light and the second range of wavelengths of visible light at least partially overlap.

In yet another embodiment, the golf ball comprises at least two indicia including a first indicia and a second indicia; wherein the first indicia is formed from a first fluorescent composition; wherein the second indicia is formed from a second fluorescent composition; wherein the first fluorescent composition emits light within a first range of wavelengths of visible light as measured according to ASTM E2153-01 (2017); wherein the second fluorescent composition emits light within a second range of wavelengths of visible light as measured according to ASTM E2153-01 (2017); and wherein the first range of wavelengths of visible light encompasses the second range of wavelengths of visible light.

It is envisioned that indicia may be applied or otherwise formed on a substrate layer directly, and/or after roughening the substrate layer, and/or via a transfer medium such as but not limited to a pad, etc.

Golf balls of the invention may also or otherwise include conventional colorants and/or color effects in a layer and/or indicia comprising the fluorescent composition or in a different layer/indicia. Conventional colorants include for example, chromophore-based pigments, dyes, tints, inks, etc. which absorb light selectively within wavelengths of visible light as well as non-chromophore-based coloring agents such as structured colorants, wherein color is produced based on the light scattering properties of a photonic pigmented layer incorporating photonic pigments.

Golf ball layers may also include conventional backer pigments and/or color effects such as but not limited to luster pigments, interference pigments and/or pearlescent pigments, non-limiting examples of which are disclosed in U.S. Pat. No. 8,119,735 of Hebert et al; U.S. Pat. No. 9,205,304 of Hogge et al.; U.S. Pat. No. 10,035,043 of Hogge et al.; and/or U.S. Publication No. 2012/0021851 of Hogge, each of which is hereby incorporated by reference herein in its entirety.

It is also envisioned that conventional optical brighteners, UV absorbers, quenchers, free radical scavengers, and antioxidants can be incorporated in golf ball layers as desired. Optical brighteners absorb the invisible ultra-violet portion of the daylight spectrum and convert this energy into the longer-wavelength visible portion of the spectrum. Examples of suitable optical brighteners include, for example, stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners including derivatives of 4,4'-diamino stilbene-2,2'-disulfonic acid, 4-methyl-7-diethylamino coumarin and 2,5-bis(5-tert-butyl)-2-benzoxazolyl) thiophene.

UV absorbers are generally helpful to absorb or filter damaging light before a chromophore (the part of a molecule responsible for its color) can be formed. UV absorbers can absorb harmful UV light and transform it into harmless heat. Non-limiting examples include triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, substituted acrylonitriles, or combinations thereof. A suitable UV absorber should absorb UV light better and faster than the polymer it is added to protect against, and dissipate absorbed energy before undesirable side reactions occur.

In turn, suitable quenchers accept energy from excited polymer molecules through an energy transfer mechanism and deactivate chromophores before the excited states can undergo a reaction resulting in degradation.

On the other hand, free radical scavengers can trap radicals before undesirable reactions (polymer degradation) takes place. Suitable free radical scavengers should be capable of trapping radicals and interrupting the chain reaction that can occur in a polymer when an excited chromophore decomposes to form radicals. Free radicals typically (i) react with the polymer and/or atmospheric oxygen, or (ii) remove a hydrogen atom from the polymer thereby initiating a free radical reaction. Examples of conventional free radical scavengers include sterically hindered amines (HALS) and antioxidants. HALS are typically derivatives of 2,2,6,6-tetraamethylpiperidine and react with a free radical to give the stable nitroxyl radical.

Meanwhile, antioxidants can potentially prolong the service life of a broad range of polymers. Common primary antioxidants include amines and phenolic antioxidants, which are chain terminating. Phenolic antioxidants are often used to inhibit thermo-oxidation at higher processing temperatures (e.g., >150° C.) and catalyze formation of a stable phenoxy radical to terminate free radical chain reactions initiated in a polymer.

Given these different roles, "stabilizer packages" comprised of anti-degradants from several of these classes may be included in golf balls of the invention.

Golf balls of the present invention may have any known construction, so long as at least one layer and/or coating and/or an indicia is formed from a fluorescent composition as disclosed herein. Golf balls of the invention may contain any number of other layers comprising any known composition and have any known dimensions and possess any known golf properties. Golf balls of the invention may have any known dimple count.

Thus, golf balls of the invention may have any known diameter; cores of golf ball of the invention may have any known diameter; and golf ball layer(s), including golf ball layer(s) formed from a fluorescent composition, may have any known thickness. Non-limiting examples of suitable core diameters range from less than 0.5 inches up to about 1.8 inches. Non-limiting examples of suitable coating layer thicknesses range from 0.1 mil to 35.0 mils, or from 0.1 mil to mils, or from 0.1 mil to 10.0 mils, or from 0.1 mil to 5.0 mils, or from 0.1 mil to 3.0 mils. Non-limiting examples of suitable non-coating layer thicknesses range from 0.005 inches to inches.

Conventional logo(s) and/or other print such as UV print may also or alternatively be provided on any layer surface of a golf ball of the invention.

Furthermore, golf ball layers may be applied or molded using any known suitable process in view of the particular polymer composition selected for the given fluorescent composition, the pre-selected layer thickness, and/or the specific layer-type (inner core, intermediate layer, outer cover, coating layer) being formed from the fluorescent composition. For example, the golf ball layers, including a layer formed from fluorescent composition, may be formed using compression molding, flip molding, injection molding, retractable pin injection molding, reaction injection molding (RIM), liquid injection molding (LIM), casting, vacuum forming, particle coating, flow coating, spin coating, dipping, spraying, and the like. Conventionally, compression molding and injection molding are applied to thermoplastic materials, whereas RIM, liquid injection molding, and casting are employed on thermoset materials.

Layers of golf balls of the invention other than coating layers may have various hardnesses and hardness gradients as known in the golf ball art depending on the particular golf ball playing characteristics being targeted. Non-limiting examples of suitable hardness ranges include from 35 Shore C to about 98 Shore C, or 50 Shore C to about 90 Shore C, or 60 Shore C to about 85 Shore C, or 45 Shore C to about 75 Shore C, or 40 Shore C to about 85 Shore C, or from about 20 Shore D to about 90 Shore D, or from about 30 Shore D to about 60 Shore D, or from about 40 Shore D to about 50 Shore D, or 50 Shore D or less, or greater than 50 Shore D.

Of course, advantageously, a resulting golf ball of the invention created using the method of the invention may have any known hardness gradient and in any known hardness scale in the golf ball art such as Shore C, Shore D, Shore M, etc.

Thermoset and thermoplastic layers herein may be treated in such a manner as to create a positive or negative hardness gradient within and between golf ball layers. In golf ball layers of the present invention wherein a thermosetting rubber is used, gradient-producing processes and/or gradient-producing rubber formulation may be employed. Gradient-producing processes and formulations are disclosed more fully, for example, in U.S. Pat. Nos. 7,678,312; 7,537,530; 7,537,529; 7,429,221; and 7,410,429; the entire disclosures of which are hereby incorporated herein by reference.

Golf balls of the invention and the materials of layers thereof may have a Coefficient of Restitution (CoR) of at least 0.700, or 0.750 or greater, or at least 0.800. CoR is determined according to a known procedure, wherein a golf ball or golf ball sub-assembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The CoR is then calculated as the ratio of the ball's outgoing transit time period to the ball's incoming transit time period ($COR=V_{out}/V_{in}=T_{in}/T_{out}$).

Additional examples of other suitable golf ball compositions, dimensions, golf properties methods for measuring properties of golf balls of the invention and methods for making golf balls of the invention are disclosed in the following co-owned patents/publications, each of which is hereby incorporated by reference herein in its entirety: U.S. Pat. No. 11,040,250, U.S. U.S. Pat. Nos. 10,596,419, 10,016,659, 10,661,123, 10,967,225, U.S. U.S. Pat. Nos. 10,252,113, 10,918,912, 10,814,180, 10,773,129, U.S. U.S. Pat. Nos. 10,500,444, 10,500,443, 10,427,004, 10,119,008, U.S. U.S. Pat. Nos. 10,105,575, 10,933,285, 10,933,285, 10,933,285, U.S. U.S. Pat. Nos. 10,933,285, 9,095,748, 10,428,216 and U.S. Publ. No. 2021/0094209.

For each embodiment of a golf ball and/or method of the invention disclosed herein, alternative embodiments are indeed also envisioned wherein "comprises" (e.g., "comprise", "comprised of", "comprising", etc.) may be replaced with "consists essentially of" (e.g., "consist essentially of", "consisting essentially of", etc.) and/or "consists of" (e.g., "consist of", "consisting of", etc.).

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention(s) set forth herein.

What is claimed is:

1. A golf ball comprising a layer formed from a fluorescent composition comprising:

a base polymer; and a colorant;

wherein the colorant is a small-molecule ionic isolation lattice formed from one or more fluorescent dyes and one or more cyanostar macrocycles.

2. The golf ball of claim 1, wherein the one or more fluorescent dyes include at least one dye selected from xanthenes, oxazines, styryls, cyanines, trianguleniums, or mixtures thereof.

3. The golf ball of claim 1, wherein the colorant is a dispersion of the small molecule ionic isolation lattice in a carrier medium.

4. The golf ball of claim 1, wherein the colorant is a powder.

5. The golf ball of claim 1, wherein the one or more fluorescent dyes of the small-molecule ionic isolation lattice includes a first fluorescent dye and a second fluorescent dye;

wherein the first fluorescent dye emits light within a first range of wavelengths of visible light as measured according to ASTM E2153-01 (2017);

wherein the second fluorescent dye emits light within a second range of wavelengths of visible light as measured according to ASTM E2153-01 (2017); and wherein the first range of wavelengths of visible light and the second range of wavelengths of visible light do not overlap.

6. The golf ball of claim 1, wherein the one or more fluorescent dyes of the small-molecule ionic isolation lattice includes a first fluorescent dye and a second fluorescent dye;

wherein the first fluorescent dye emits light within a first range of wavelengths of visible light as measured according to ASTM E2153-01 (2017);

wherein the second fluorescent dye emits light within a second range of wavelengths of visible light as measured according to ASTM E2153-01 (2017); and wherein the first range of wavelengths of visible light and the second range of wavelengths of visible light at least partially overlap.

7. The golf ball of claim 1, wherein the one or more fluorescent dyes of the small-molecule ionic isolation lattice includes a first fluorescent dye and a second fluorescent dye;

wherein the first fluorescent dye emits light within a first range of wavelengths of visible light as measured according to ASTM E2153-01 (2017);

wherein the second fluorescent dye emits light within a second range of wavelengths of visible light as measured according to ASTM E2153-01 (2017); and wherein the first range of wavelengths of visible light encompasses the second range of wavelengths of visible light.

8. The golf ball of claim 1, wherein the fluorescent composition of the layer is transparent or translucent.

9. The golf ball of claim 1, wherein the base polymer of the fluorescent composition of the layer is selected from ionomers, polyurethanes, polyureas, and mixtures thereof.

10. The golf ball of claim 1, wherein the golf ball comprises a core and a cover layer; wherein the cover layer is the layer formed from the fluorescent composition.

11. The golf ball of claim 10, wherein the base polymer of the fluorescent composition of the cover layer is an ionomer, a polyurethane, a polyurea, or a mixture thereof.

12. The golf ball of claim 1, wherein the golf ball comprises a core and a thermoplastic polyurethane outer cover layer; wherein the thermoplastic polyurethane outer cover layer is the layer formed from the fluorescent composition.

13. The golf ball of claim 1, wherein the golf ball comprises a core, a cover, and a coating layer; wherein the coating layer is the layer formed from the fluorescent composition.

14. The golf ball of claim 13, wherein the fluorescent composition of the coating layer is a latex, a lacquer or an enamel coating.

15. The golf ball of claim 13, wherein the fluorescent composition of the coating layer comprises an acrylic, an epoxy, a urethane, a polyester, a urethane acrylate, a polyester acrylate or an alkyd.

16. The golf ball of claim 13, wherein the fluorescent composition of the coating layer is radiation cured.

17. The golf ball of claim 1, wherein the golf ball comprises at least two coating layers including a first coating layer and a second coating layer;

wherein the first coating layer is a first layer formed from a first fluorescent composition;

wherein the second coating layer is a second layer formed from a second fluorescent composition;

wherein the first fluorescent composition emits light within a first range of wavelengths of visible light as measured according to ASTM E2153-01 (2017);

wherein the second fluorescent composition emits light within a second range of wavelengths of visible light as measured according to ASTM E2153-01 (2017); and wherein the first range of wavelengths of visible light and the second range of wavelengths of visible light do not overlap.

18. The golf ball of claim 1, wherein the golf ball comprises at least two coating layers including a first coating layer and a second coating layer;

wherein the first coating layer is a first layer formed from a first fluorescent composition;

wherein the second coating layer is a second layer formed from a second fluorescent composition;

wherein the first fluorescent composition emits light within a first range of wavelengths of visible light as measured according to ASTM E2153-01 (2017);

wherein the second fluorescent composition emits light within a second range of wavelengths of visible light as measured according to ASTM E2153-01 (2017); and wherein the first range of wavelengths of visible light and the second range of wavelengths of visible light at least partially overlap.

19. The golf ball of claim 1, wherein the golf ball comprises at least two coating layers including a first coating layer and a second coating layer;

wherein the first coating layer is a first layer formed from a first fluorescent composition;

wherein the second coating layer is a second layer formed from a second fluorescent composition;

wherein the first fluorescent composition emits light within a first range of wavelengths of visible light as measured according to ASTM E2153-01 (2017);

wherein the second fluorescent composition emits light within a second range of wavelengths of visible light as measured according to ASTM E2153-01 (2017); and wherein the first range of wavelengths of visible light encompasses the second range of wavelengths of visible light.

* * * * *